United States Patent [19]

Roller et al.

[11] 4,346,880

[45] Aug. 31, 1982

[54] APPARATUS FOR INVERTING SUBSTRATES

[75] Inventors: George J. Roller, Rochester; Richard P. Schell, Ontario, both of N.Y.

[73] Assignee: Xerox Corporation, Stamford, Conn.

[21] Appl. No.: 193,242

[22] Filed: Oct. 2, 1980

[51] Int. Cl.[3] ..... B65H 29/00

[52] U.S. Cl. ..... 271/186; 271/DIG. 9; 271/122; 271/225

[58] Field of Search ..... 271/186, 225, DIG. 9, 271/188, 122, 125; 198/373, 374, 402, 403

[56] References Cited

U.S. PATENT DOCUMENTS

| | | | |
|---|---|---|---|
| 3,401,930 | 9/1968 | Bishop | 271/225 |
| 3,523,687 | 8/1970 | Petersen | 271/186 |
| 3,942,785 | 3/1976 | Stange | 271/DIG. 9 X |
| 4,054,285 | 10/1977 | Stange et al. | 271/186 |
| 4,214,740 | 7/1980 | Acquaviva | 271/3 |
| 4,266,762 | 5/1981 | Kramer | 271/225 |

*Primary Examiner*—Richard A. Schacher
*Attorney, Agent, or Firm*—William A. Henry, II

[57] ABSTRACT

A copier capable of producing simplex and duplex copies includes a tri-roll inverter that employs a spring loaded ball on roll return force applicator located downstream from the tri-roll input/output members. The input nip of the inverter includes the combination of a smooth roll and a foam roll. This combination corrugates lightweight papers for penetrating the ball on roll nip. A sheet driven by the input nip into the inverter penetrates the ball on roll return force applicator nip. When the last portion of the sheet leaves the input nip, the friction return force of the applicator nip will cause the sheet to buckle into an output nip formed by the foam rolls of the tri-roll members for outward movement.

10 Claims, 3 Drawing Figures

APPARATUS FOR INVERTING SUBSTRATES

The present invention relates to an improved sheet inverting system, and more particularly to an inverter providing improved handling of variable sized sheets within the inverter which employs a return force applicator.

As xerographic and other copiers increase in speed, and become more automatic, it is increasingly important to provide higher speed yet more reliable and more automatic handling of both the copy sheets being made by the copier and the original document sheets being copied. It is desired to accommodate sheets which may vary widely in size, weight, thickness, material, condition, humidity, age, etc. These variations change the beam strength or flexural resistance and other characterisitics of the sheets. Yet the desire for automatic and high speed handling of such sheets without jams, misfeeds, uneven feeding times, or other interruptions increases the need for reliability of all sheet handling components. A sheet inverter is one such sheet handling component with particular reliability problems.

Although a sheet inverter is referred to in the copier art as an "inverter", its function is not necessary to immediately turn the sheet over (i.e., exchange one face for the other). Its function is to effectively reverse the sheet orientation in its direction of motion. That is, to reverse the lead edge and trail edge orientation of the sheet. Typically in inverter devices, as disclosed here, the sheet is driven or fed by feed rollers or other suitable sheet driving mechanisms into a sheet reversing chute. By then reversing the motion of the sheet within the chute and feeding it back out from the chute, the desired reversal of the leading and trailing edges of the sheet in the sheet path is accomplished. Depending on the location and orientation of the inverter in a particular sheet path, this may, or may not, also accomplish the inversion (turning over) of the sheet. In some applications, for example, where the "inverter" is located at the corner of a 90° to 180° inherent bend in the copy sheet path, the inverter may be used to actually prevent inverting of a sheet at that point, i.e., to maintain the same side of the sheet face-up before and after this bend in the sheet path. On the other hand, if the entering and departing path of the sheet, to and from the inverter, is in substantially the same plane, the sheet will be inverted by the inverter. Thus, inverters have numerous applications in the handling of either original documents or copy sheets to either maintain, or change, the sheet orientation.

Inverters are particularly useful in various systems of pre or post collation copying, for inverting the original documents, or for maintaining proper collation of the sheets. The facial orientation of the copy sheet determines whether it may be stacked in forward or reversed serial order to maintain collation. Generally, the inverter is associated with a by-pass sheet path and gate so that a sheet may selectively by-pass the inverter, to provide a choice of inversion or non-inversion. The present invention may be utilized, for example, in the chute inverter of a simplex/duplex copying system of the type disclosed in U.S. Patent application Ser. No. 071,613, filed Aug. 31, 1979, by the same Assignee, in the name of Ravi B. Sahay (D/78008).

Typically in a reversing chute type inverter, the sheet is fed in and then wholly or partially released from a positive feeding grip or nip into the inverter chute, and then reacquired by a different feeding nip to exit the inverter chute. Such a temporary loss of positive gripping of the sheet by any feed mechanism during the inversion increases the reliability problems of such inverters. Also, when the inverter is in a verticle plane and a ball on roll sheet return mechanism is used in the inverter end position, lightweight sheets encounter difficulty trying to pass between the ball on roll. The same is also true when the ball on roll return mechanism is in the horizontal plane.

The present invention is directed to improving the reliability of the inverter in this and other critical aspects of this operation, yet to also accommodate a range of different sheet sizes within the same size inverter and the same mechanism. The present invention provides these improvements with an extremely low cost and simple inverter apparatus having a uniquely constructed and positioned constantly rotating ball on roll retard drive mechanism located downstream of unique tri-roll sheet input and output drives. The ball is pressed against the roll by the use of a Delrin button that is compression spring loaded.

As noted above, many inverters, particularly those utilizing only gravity, have reliability problems in the positive output or return of the sheet at a consistent time after the sheet is released in the inverter chute. Those inverters which use chute drive rollers or other drive mechanisms have a more positive return movement of the sheet, but this normally requires a movement actuator (clutch or solenoid) for the drive and either a sensor or a timing mechanism to determine the proper time to initiate the actuation of this drive mechanism so that is does not interfer with the input movement of the sheet, and only thereafter acts on the sheet to return it to the exit nip or other feed-out means. Furthermore, inverter reliability problems are aggravated by variations in the condition or size of the sheet. For example, a pre-set curl in the sheet can cause the sheet to assume an undesirable configuration within the chute when it is released therein, and interfere with feed-out.

In contrast, the inverter disclosed herein can provide positive buckling of the sheet between drive rollers located within a chute engaging the lead edge of the sheet and an input feeder which is pushing the trail edge of the sheet into the chute, for a positive sheet ejection force. Yet a conventional range of sheet dimensions, and a wide range of sheet thicknesses and weights, may be accommodated within this inverter chute, without sacrificing reliability of output feeding from the inverter chute. The inverter disclosed herein allows a highly accurate and compact inverter configuration.

A preferred feature of the present invention is to provide in a sheet inverter mechanism with sheet feed means for feeding a sheet into and out of a first end of a sheet reversing chute, to reverse the lead and trail edge orientation of the sheet, the improvement comprising nip means located within and at a second end of the chute for applying a constant force to the sheet that is opposite to the initial sheet direction as the sheet is being driven toward the nip means, said nip means includes means for spring loading the ball on the roll.

A further preferred feature is to provide, in a method of reversing the direction of sheets of variable dimensions by feeding them into one end of a sheet reversing chute and feeding them out of the same end of said chute so that the lead edge and trail edge orientation of the sheets is reversed, the improvement comprising driving the lead edge of the sheets into said chute by contact with a smooth roll and a first foam roll, applying a return force against the sheets as they are driven into said chute, said return force being applied by a ball on roll nip with said ball on roll constantly rotating in a direction opposite to the incoming direction of the sheets in order to buckle and thereby positively urge the trail edge of the sheets against said foam roll and back out from the chute with the assistance of a second foam roll that forms an output driving nip with said first foam roll.

Further features and advantages of the invention pertain to the particular apparatus and steps whereby the above noted aspects of the invention are attained. Accordingly, the invention will be better understood by reference to the following description, and to the drawings forming a part thereof, which are approximately to scale, wherein.

Figure 1:
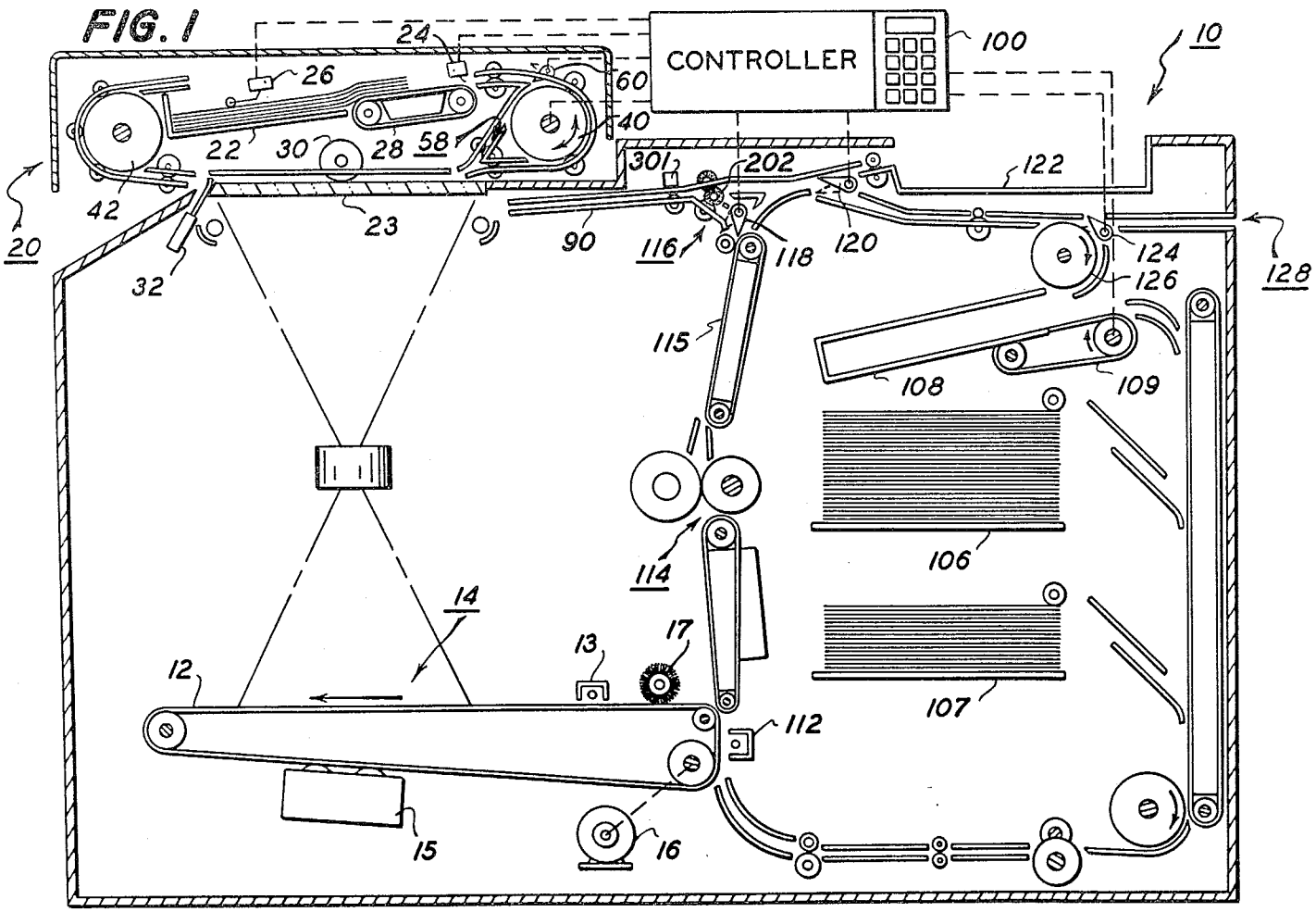
FIG. 1 is a schematic side view of an exemplary copier incorporating an aspect of the present invention.

Referring to the exemplary xerographic copier 10 shown in FIG. 1, and its exemplary automatic document feeding unit 20, it will be appreciated that various other recirculating document feeding units and copiers may be utilized with the present invention. This copier is described in detail in U.S. application Ser. No. 071,613, filed Aug. 31, 1979, and is incorporated herein by reference to the extent necessary for the practice of the present invention.

The exemplary copier 10 conventionally includes a xerographic photoreceptor belt 12 and the xerographic stations acting thereon for respectively charging 13, exposing 14, developing 15, driving 16 and cleaning 17. The copier 10 is adapted to provide duplex or simplex pre-collated copy sets from either duplex or simplex original documents copied from the recirculating document handler 20. Two separate copy sheet trays 106 and 107 are provided to feed clean copy sheets from either one. The control of the sheet feeding is, conventionally, by the machine controller 100. The controller 100 is preferably a known programmable microprocessor as exemplified by U.S. Pat. No. 4,144,450, issued to J. Donahue et al. on Mar. 13, 1979, which conventionally also controls all of the other machine functions described herein including the operation of the document feeder, the document and copy sheet gates, the feeder drives, etc., and is incorporated herein by reference. As further disclosed, it also conventionally provides for storage and comparison of the counts of the copy sheets, the number of documents recirculated in a document set, the number of copy sets selected by the operator through the switches thereon, etc.

The copy sheets are fed from a selected one of the trays 106 or 107 to the xerographic transfer station 112 for the transfer of the xerographic image of a document page to one side thereof. The copy sheets here are then fed through vacuum transports vertically up through a conventional roll fuser 114 for the fusing of the toner image thereon. From the fuser, the copy sheets are fed to a gate 118 which functions as an inverter selector finger. Depending on the position of the gate 118, the copy sheets will either be deflected into a sheet inverter 116 or bypass the inverter and be fed directly onto a second decision gate 120. Those copy sheets which bypass the inverter 116 (the normal path here) have a 90° path deflection before reaching the gate 120 which inverts the copy sheets into a face-up orientation, i.e., the image side which has just been transferred and fused is face-up at this point. The second decision gate 120 then either deflects the sheets without inversion directly into an output tray 122 or deflects the sheets into a transport path which carries them on without inversion to a third decision gate 124. This third gate 124 either passes the sheets directly on without inversion into the output path 128 of the copier, or deflects the sheets into a duplex inverting roller transport 126. The inverting transport 126 feeds the copy sheets into a duplex tray 108. The duplex tray 108 provides intermediate or buffer storage for those copy sheets which have been printed on one side and on which it is desired to subsequently print an image on the opposite side thereof, i.e., the sheets being duplexed. Due to the sheet inverting by the roller 126, these buffer set copy sheets are stacked into the duplex tray face-down. They are stacked in the duplex tray 108 on top of one another in the order in which they were copied.

For the completion of duplex copying, the previously simplexed copy sheets in the tray 108 are fed seriatim by the bottom feeder 109 from the duplex tray back to the transfer station for the imaging of their second or opposite side page image. This duplex copy sheet path is basically the same copy sheet path provided for the clean sheets from the trays 106 or 107, illustrated at the right hand and bottom of FIG. 1. It may be seen that this sheet feed path between the duplex feeder 109 and the transfer station 112 inverts the copy sheets once. However, due to the inverting roller 126 having previously stacked these sheets face-down in the tray 108, they are presented to the transfer station 112 in the proper orientation, i.e., with their blank or opposite sides facing the photoreceptor 12 to receive the second side image. The now duplexed copy sheets are then fed out through the same output path through the fuser 114 past the inverter 116 to be stacked with the second printed side faceup. These completed duplex copy sheets may then be stacked in the output tray 122 or fed out past the gate 124 into the output path 128.

The output path 128 transports the finished copy sheets (simplex or duplex) either to another output tray, or, preferably, to a finishing station where the completed pre-collated copy sheets may be separated and finished by on-line stapling, stitching, glueing, binding, and/or off-set stacking.

Figure 2:
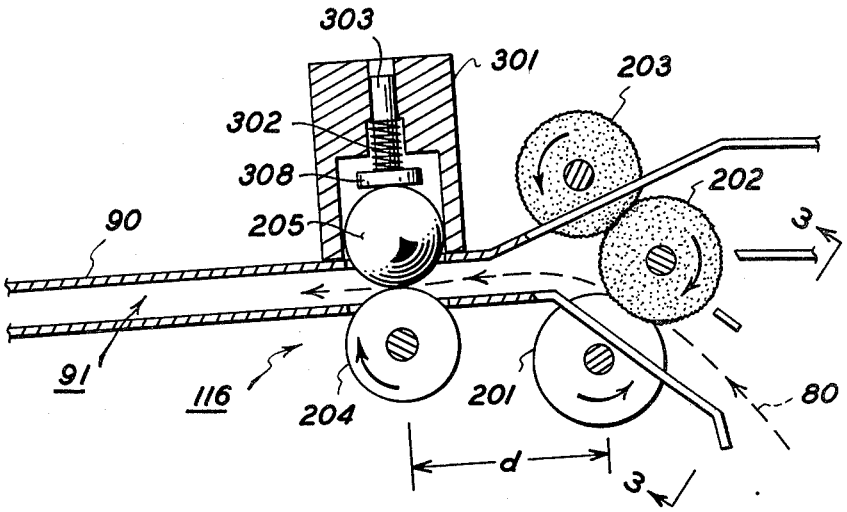
FIG. 2 is an exploded side view of the inverter shown in FIG. 1.

In reference to an aspect of the present invention and FIG. 2, when inversion of copy sheets is required, for example, job recovery, maintaining face-up or face-down output collation, simplex/duplex copying with an odd number of simplex copies, etc., tri-roll inverter 116 is used. Copy sheets are fed from either tray 106 or 107 past transfer means 112 and onto conveyor 115. As a sheet leaves conveyor 115, it approaches decision gate 118 which is controlled by controller 100. Gate 118 is actuated to the right as viewed in FIG. 1 which causes sheet 80 to be deflected into an input formed between rollers 201 and 202. These rollers drive the sheet into chute 91 and subsequently into a ball on roll nip formed between idler ball 205 and drive roller 204 which is driven by conventional means (not shown). Drive roller 204 is constantly rotating in a clockwise direction which is opposite to input drive roller 201 which is driven by center roll 202 that drives both input and output rollers 201 and 203, respectively. The nip formed between drive roller 204 and ball 205 has slight frictional characteristics and, therefore, apply a continuous retard force against the incoming sheet. However, this retarding force is not enough to inhibit forward movement of the incoming sheet through the nip. When the last portion of the sheet 80 leaves the nip between rollers 201 and 202, the friction force of nip 204, 205 will cause the sheet to buckle around roller 202 and into the output nip formed by rollers 202 and 203 for outward movement. As soon as the sheet is "walked" around roller 202 to the exit nip and is under control of the output rollers, the next sheet can be fed into the inverter allowing simultaneous sheet inversion. After moving through nip 202, 203, the sheet approaches gate 120 which is actuated by controller 100 into either the dotted line or solid line positions shown in FIG. 1 depending on the reason for inverting. As an alternative, two Teflon balls 205 in tandem or series within housing 301 will allow the ball in contact with the drive roller to turn more easily when coming into contact with the incoming sheet.

Figure 3:
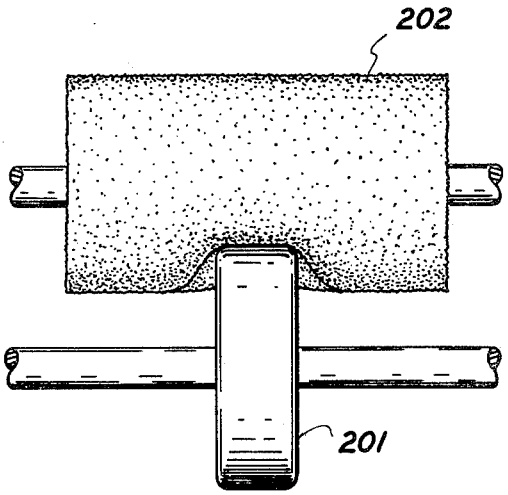
FIG. 3 is a partial end view of the embodiment of the invention shown in FIG. 2 taken along line 3—3.

The tri-roll inverter system of the present invention has advantages over prior tri-roll inverters in that the present system inverts sheets of wide differences in weights and sizes with equal ease whether the inversion takes place with the inverter in a horizontal or vertical plane. This universality of inverter 116 is accomplished by the use of the tri-roller comprising an input shaft assembly of smooth rollers 201, and two shaft assemblies of foam rollers 202 and 203 (only one of each is shown). The smooth rollers serve two purposes. They corrugate lightweight papers for penetrating the reversing nip formed between Teflon ball 205 and roll 204 such that the higher the weight of the paper 80, the less corrugation is produced, i.e., lightweight paper will conform as shown in FIG. 3 to the shape of the nip formed between rollers 201 and 202 and the smooth rollers insure that the foam rollers control the trail edge of the sheet. While a sheet is being fed through the input nip, it has to penetrate reversing retard nip 204, 205. Another advantage of this system over previous systems is the inclusion of spring loaded Derlin button or other polymeric button 308 for point normal force contact on ball 205. This device allows variable pressure to be applied to incoming sheets depending on the weight of the sheets. Derlin button 308 is located within a housing 301 and has a shaft 303 attached thereto that rides within a channel located within the housing. Compression spring 302 makes the button 308 normal force adjustable depending on the weight of the sheets being inverted.

The drive force of rollers 204 will buckle the trail edges of sheets leaving the input nip into foam rollers 202, and since the rollers are pliable, the sheets will easily ride along the surface of rollers 202 into the output nip formed by foam rollers 202 and 203. The ease of workability of the present system is enhanced by the proximity of the ball on roll to the input nip. Positioning the ball on roll nip a distance of between 4 and 8 inches from the input nip reduced the length of the sheet beam thereby increasing the sheet beam strength. Along with the corrugation achieved by the foam roll and smooth roll input nip, the chance of the sheet collapsing as it enters the ball on roll nip is reduced.

In conclusion, a substrate inverter is disclosed that includes an input nip formed by smooth rollers 201 and foam rollers 202. Rollers 202 drive the substrate material 80 through a retard drive force applicator having a nip formed between spring loaded ball 205 and drive roller 204. The roller 204 is rotating in a direction to oppose the motion of the incoming substrate with a small friction force. However, this friction force is small enough so as to allow the incoming substrate to be forced through the nip. After the last portion of the substrate passes through the input nip, the friction force from the ball on roll nip forces the trail edge of the incoming sheet to maintain contact with foam roller 202. This causes the trail edge to "walk around" to the exit nip formed between foam rollers 202 and 203. As soon as the substrate is under control of the exit nip, the next substrate can be fed into the inverter allowing simultaneous substrate inversion.

While the inverter system disclosed herein is preferred, it will be appreciated that various alternatives, modifications, variations or improvements thereon may be made by those skilled in the art, and the following claims are intended to encompass all of those falling within the true spirit and scope of the invention.

What is claimed is:

1. A substrate inverter, comprising:

(a) inversion channel means;

(b) input drive means for driving a substrate into said channel means, said input drive means including a smooth roll and an elastomeric roll that forms an input nip, said smooth roll having a narrower width than said elastomeric roll;

(c) output drive means for driving a substrate out of said channel means, said output drive means including said elastomeric roll; and (d) return nip means located within said channel means and downstream of said input drive means and arranged for applying a continuous force to the substrate in a direction opposite to the initial incoming sheet direction while and at the same time the substrate is being influenced by said input means, whereby as the last portion of the substrate leaves said input means the force of said nip means will drive the substrate into said output means for movement out of said channel means.

2. The inverter of claim 1, wherein said elastomeric rolls are foam rolls.

3. The inverter of claim 1, wherein a lightweight substrate is corrugated such that it conforms to the shape of said input nip elastomeric roll.

4. The inverter of claim 1, wherein said return nip means includes a ball in contact with a drive roll, said ball having a point contact normal force applied thereto to a spring loaded button.

5. The inverter of claim 4, wherein said return nip means includes at least two balls in a series with one of the balls in contact with said drive roller.

6. The inverter of claim 1, wherein a substrate is prevented from buckling as it enters said return force nip due to the close proximity of said return force nip to said input drive nip.

7. In a substrate inverter mechanism with feed means for feeding a substrate into and out of a first end of a substrate reversing chute to reverse the lead and trail edge orientation of the substrate, the improvement comprising:

retard means applicator means for receiving the substrate from said feed means and applying a retard frictional force to the substrate while and at the same time the substrate is being received, whereby as the last portion of the substrate leaves said feeding means coming into said reversing chute the friction force of said applicator means will cause the sheet to feed out of said reversing chute, said retard feed applicator means includes a nip formed by a drive roll and an idler member, said idler member having point contact normal force applied thereto by a spring biased button.

8. In a copier having means for imaging both sides of a document, copy sheet feeding means for feeding copy sheets to receive the images and inverter means for inverting the copy sheets as required for proper output orientation, said inverter means having a channel and including input and output drive means located adjacent one end of the channel, the improvement comprising:

retard force applicator means located downstream from input and output drive means for receiving the copy sheets from the input drive means, said applicator means applying a driving force counter to the force applied by said input drive means to the sheets while and at the same time the sheets are being driven by the input drive means, whereby as the sheets leave the drive force of the input drive means the drive force of said applicator means will cause the sheets to deflect over to the output drive means and be driven out of the inverter, said applicator means includes a ball in contact with a driving roller, said ball having a point contact normal force applied thereto by a spring biased button.

9. The improvement of claim 8, wherein said input drive means comprises a nip formed by a smooth surfaced drive roller and a foam roller.

10. The improvement of claim 9, wherein said output drive means comprises two foam rollers that form a nip.

* * * * *